US011659941B2

(12) United States Patent
Paperno

(10) Patent No.: US 11,659,941 B2
(45) Date of Patent: May 30, 2023

(54) SUPPORT ASSEMBLY FOR INFANT

(71) Applicant: Steven Paperno, Westlake Village, CA (US)

(72) Inventor: Steven Paperno, Westlake Village, CA (US)

( * ) Notice: Subject to any disclaimer, the term of this patent is extended or adjusted under 35 U.S.C. 154(b) by 123 days.

(21) Appl. No.: 16/736,264

(22) Filed: Jan. 7, 2020

(65) Prior Publication Data

US 2020/0214471 A1 Jul. 9, 2020

Related U.S. Application Data

(63) Continuation-in-part of application No. 15/254,766, filed on Sep. 1, 2016, now Pat. No. 10,842,292.

(60) Provisional application No. 62/794,031, filed on Jan. 18, 2019.

(51) Int. Cl.
*A47D 15/00* (2006.01)
*A47D 13/08* (2006.01)

(52) U.S. Cl.
CPC ..... *A47D 15/008* (2013.01); *A47D 13/083* (2013.01)

(58) Field of Classification Search
CPC .. A47D 15/008; A47D 13/083; A47D 15/001; A47D 15/005
USPC ..... 5/655
See application file for complete search history.

(56) References Cited

U.S. PATENT DOCUMENTS 309,678 A 12/1884 Aubin
D103,216 S 2/1937 Cevasco
D139,630 S 12/1944 Wade
2,876,459 A 3/1959 Ackerson
3,269,621 A * 8/1966 Dishart ..... A47D 15/008 224/159
3,443,066 A 5/1969 Wiebel
3,667,074 A 6/1972 Emery
(Continued)

FOREIGN PATENT DOCUMENTS

CN 101258972 A 9/2008
CN 102481023 5/2012
(Continued)

OTHER PUBLICATIONS

Roy Benaroch, "Pediatric Insider", Jun. 11, 2014, p. 3 (Year: 2014).*
(Continued)

*Primary Examiner* — David R Hare
*Assistant Examiner* — Luke Hall
(74) *Attorney, Agent, or Firm* — Knobbe, Martens, Olson & Bear, LLP

(57) ABSTRACT

An infant support pad assembly has a body of resilient material, a generally planar bottom surface and a top surface that is inclined relative to the bottom surface between a proximal end and a distal end of the body such that the infant is in an inclined position when placed on the body. The top surface has an opening in a distal portion of the body and curved surface configured to receive and support at least a portion of an infant's head. The support pad assembly also has a pair of raised side members on either side of the top surface configured to generally maintain the infant on the body and inhibit movement of the infant out of the body. The support pad assembly also has an outer padding to at least partially surround the body to generally maintain the infant on the body.

6 Claims, 16 Drawing Sheets

(56) References Cited

U.S. PATENT DOCUMENTS 3,721,434 A 3/1973 Spies
4,087,874 A 5/1978 Callaway et al.
D259,458 S 6/1981 Fuller et al.
D267,678 S 1/1983 Breen
4,631,766 A 12/1986 Semmler et al.
D289,481 S 4/1987 Reddick
4,788,726 A 12/1988 Rafalko
4,825,487 A 5/1989 Eberl
4,862,535 A * 9/1989 Roberts ..... A47D 15/008 604/386
4,907,306 A 3/1990 Nakaji
5,014,376 A * 5/1991 Doran ..... A47D 15/008 5/655
D322,001 S 12/1991 Meeker
D322,312 S 12/1991 Mombrinie
D327,198 S 6/1992 Erker, Jr.
5,127,422 A * 7/1992 Colon ..... A47D 13/08 5/655
D334,318 S 3/1993 Chee
5,216,772 A * 6/1993 Clute ..... A47D 13/08 5/655
D342,855 S 1/1994 Butler, II
5,317,767 A 6/1994 Hargest et al.
5,333,769 A 8/1994 Skroski
5,347,669 A * 9/1994 Neviaser ..... A47D 15/008 5/655
5,409,411 A * 4/1995 Schrieber ..... B63C 9/08 5/655
D370,586 S 6/1996 Olah
5,524,640 A 6/1996 Lisak et al.
5,546,618 A 8/1996 Beedy
5,546,620 A 8/1996 Matthews
5,551,108 A 9/1996 Butler, III
5,551,109 A 9/1996 Tingley et al.
5,566,413 A 10/1996 Webb
5,567,008 A * 10/1996 Cone, II ..... B60N 2/2821 297/256.16
D376,288 S 12/1996 Antonian
5,611,095 A 3/1997 Schneider
D398,182 S 9/1998 Smith
5,800,368 A 9/1998 Klingeman et al.
D404,238 S 1/1999 Keilhauer
D416,428 S 11/1999 Jackson
5,988,744 A 11/1999 Franchak
D417,568 S 12/1999 Pike
6,023,802 A 2/2000 King
6,036,263 A 3/2000 Gold
6,068,322 A 5/2000 Kuester
6,230,352 B1 * 5/2001 Kasem ..... A47G 9/0246 5/722
6,256,803 B1 7/2001 Sauerbrei et al.
6,321,403 B1 11/2001 Matthews
D463,701 S 10/2002 Borcherding
D466,750 S 12/2002 Landvik
D469,648 S 2/2003 Meldeau
6,513,164 B1 2/2003 Hearsm
D474,637 S 5/2003 Scheetz
D487,373 S 3/2004 Ku
6,796,606 B2 * 9/2004 Marshall ..... B60N 2/6009 297/256.16
D497,507 S 10/2004 Keilhauer
D497,727 S 11/2004 Monsalve
D500,622 S 1/2005 Owen
6,857,150 B2 2/2005 Matthews
D504,045 S 4/2005 Rediske
6,931,683 B1 8/2005 Elkin et al.
6,983,813 B1 1/2006 Wright
7,003,832 B2 2/2006 Wilson
D523,680 S 6/2006 Burke
7,076,819 B2 7/2006 Trani et al.
D529,319 S 10/2006 Shibata
7,140,057 B2 11/2006 Hetzel
7,234,181 B1 * 6/2007 Griggs ..... A47D 13/08 5/655
D552,244 S 10/2007 Tinsley
D555,917 S 11/2007 Erli
D556,286 S 11/2007 Peterson
D558,292 S 12/2007 Engaldo
D572,958 S 7/2008 Keilhauer
D576,408 S 9/2008 Forshpan
7,584,515 B2 9/2009 Jones et al.
7,647,660 B2 * 1/2010 Tullous ..... A47D 13/08 5/655
D610,853 S 3/2010 Straub
D611,259 S 3/2010 Yeung
D624,344 S 9/2010 Kashey
7,958,582 B1 6/2011 Scamardo
D642,278 S 7/2011 Sharps
D642,280 S 7/2011 Goumas
D646,066 S 10/2011 Debevec
8,032,958 B2 10/2011 Pieta et al.
D650,558 S 12/2011 Ruse-Petersen
8,074,312 B2 12/2011 Tullous
D656,749 S 4/2012 Bergkvist
8,151,389 B1 * 4/2012 Lando ..... A47D 15/005 5/655
D658,394 S 5/2012 Debevec
8,191,188 B2 6/2012 Kaplan et al.
D670,088 S 11/2012 Wozniak
D670,090 S 11/2012 Miucci
D672,567 S 12/2012 Sclare
D674,614 S 1/2013 Morand
8,474,079 B1 * 7/2013 Gangitano ..... A47C 21/048 5/733
D698,448 S * 1/2014 Heck ..... D24/191
8,640,289 B2 * 2/2014 Reeder, Jr. ..... A47D 15/008 5/636
8,650,685 B1 * 2/2014 Ford ..... A41B 13/06 5/655
8,667,631 B2 3/2014 Coates
8,671,486 B1 * 3/2014 Paperno ..... A47D 13/00 5/655
D702,459 S 4/2014 Scarlett
8,726,436 B2 5/2014 Wright
D707,358 S 6/2014 Mantilla
8,769,737 B1 * 7/2014 Duggins ..... A47D 7/00 5/915
D714,072 S 9/2014 Nadeau
D718,074 S * 11/2014 Savolainen ..... D6/601
8,938,830 B2 1/2015 Paperno
D723,305 S 3/2015 Paperno
D731,813 S * 6/2015 Durkin ..... D6/601
D732,174 S 6/2015 Johnson
D732,312 S * 6/2015 Tiffin ..... D6/601
D732,313 S 6/2015 Fux
D733,897 S 7/2015 Rossouw
D734,545 S 7/2015 Cantu
D734,546 S 7/2015 Baker
D736,391 S 8/2015 Johnson
D743,186 S 11/2015 Perdue
9,237,771 B2 1/2016 Paperno
D756,687 S * 5/2016 Durkin ..... D6/601
D759,406 S 6/2016 Peterson
D773,858 S 12/2016 Takashima
D782,237 S 3/2017 Caforio
D800,480 S 10/2017 Paperno
D808,195 S 1/2018 Wyborn
2002/0108176 A1 * 8/2002 Ragen ..... A47D 13/08 2/69.5
2002/0133881 A1 9/2002 Vrbas
2002/0174488 A1 * 11/2002 Appleton ..... A47D 7/02 5/731
2003/0000018 A1 * 1/2003 Lanteri ..... A47G 9/10 5/636
2004/0195880 A1 * 10/2004 Gardner ..... A47D 13/08 297/250.1
2004/0250351 A1 * 12/2004 Brewin ..... A47D 15/008 5/655
2005/0028286 A1 * 2/2005 Smart ..... A47D 15/008 5/655
2005/0115000 A1 * 6/2005 Kassai ..... A47D 15/003 5/655

(56) References Cited

U.S. PATENT DOCUMENTS

2005/0198739 A1* 9/2005 Elkin ..... A61G 7/065 5/655
2005/0210592 A1* 9/2005 Littlehorn ..... A47D 15/003 5/655
2005/0278856 A1 12/2005 Welch
2006/0010600 A1 1/2006 Kendy
2006/0042013 A1 3/2006 Madsen
2006/0096031 A1* 5/2006 Foster ..... A47D 13/08 5/655
2006/0282953 A1* 12/2006 Telegadis ..... A47D 15/003 5/655
2007/0062988 A1 3/2007 Kassai et al.
2007/0157392 A1 7/2007 Ragen
2007/0163051 A1* 7/2007 Straub ..... A47D 13/08 5/655
2007/0283502 A1* 12/2007 Tullous ..... A61F 5/05891 5/733
2008/0092299 A1* 4/2008 Gudel Kemm ..... A47D 13/08 5/655
2008/0092300 A1* 4/2008 Joe ..... A47D 15/008 5/655
2008/0172795 A1 7/2008 Straub
2008/0178387 A1* 7/2008 Kachtick-Anders ... A61G 7/065 5/603
2008/0201855 A1 8/2008 Groves
2008/0216246 A1 9/2008 Groves
2008/0263766 A1 10/2008 Omar
2009/0001801 A1* 1/2009 Gold ..... A47D 15/001 297/452.47
2009/0007336 A1* 1/2009 Kassai ..... A47G 9/1081 5/655
2009/0235461 A1* 9/2009 Straub ..... A47D 15/008 5/655
2010/0192305 A1 8/2010 Telegadis et al.
2010/0235992 A1* 9/2010 Bensoussan ..... A61G 7/05784 5/724
2010/0237675 A1* 9/2010 Merritt ..... B60N 2/882 297/393
2010/0257653 A1* 10/2010 Pitts ..... A41B 13/06 2/69.5
2010/0257654 A1 10/2010 Waters et al.
2011/0083276 A1 4/2011 Pieta et al.
2011/0162657 A1* 7/2011 Tullous ..... A47D 15/008 128/845
2011/0197364 A1* 8/2011 Wadia ..... A47D 13/02 5/655
2011/0197365 A1 8/2011 Wadia
2011/0271455 A1* 11/2011 Park ..... A47D 13/02 5/655
2012/0186025 A1* 7/2012 Kardos ..... A47C 20/027 5/652
2013/0047339 A1* 2/2013 Kim ..... A47G 9/109 5/636
2013/0298333 A1* 11/2013 Chen ..... A47G 9/1081 5/636
2013/0326811 A1 12/2013 Miles et al.
2013/0333113 A1* 12/2013 Gotel ..... A41B 13/065 5/494
2014/0020176 A1* 1/2014 Coates ..... A41B 13/06 5/494
2014/0026323 A1* 1/2014 Bowers ..... A47G 9/109 5/636
2014/0082848 A1* 3/2014 Fort ..... A47D 5/00 5/655
2014/0250595 A1 9/2014 Paperno
2015/0040315 A1* 2/2015 Gersin ..... A61H 23/0263 5/417
2015/0128350 A1* 5/2015 Paperno ..... A41B 13/06 5/655
2015/0374138 A1* 12/2015 Park ..... A47D 15/008 5/655
2017/0119624 A1* 5/2017 Kim ..... A47G 9/10
2017/0156958 A1* 6/2017 Roh ..... A47G 9/109

FOREIGN PATENT DOCUMENTS

| | | |
|---|---|---|
| EP | 0 862 901 | 9/1998 |
| EP | 1525825 | 4/2005 |
| EP | 1 795 090 | 6/2007 |
| JP | H07-275091 | 10/1995 |
| JP | 2005/124639 | 5/2005 |
| JP | H 2007/275091 | 10/2007 |
| JP | 2008-000279 | 1/2008 |
| NZ | 510421 | 1/2004 |
| WO | WO 2004/082436 | 9/2004 |
| WO | WO 2009/124361 | 10/2009 |
| WO | WO 2014/129739 | 8/2014 |
| WO | WO 2018/044932 A1 | 3/2018 |

OTHER PUBLICATIONS

Canadian Office Action in Patent Application No. CA 2,978,743 dated Jul. 15, 2019 in 5 pages.
Chinese Office Action for Chinese Patent Application No. 2017800010819, dated Sep. 17, 2020 in 22 pages.
Canadian Office Action in Patent Application No. CA 2978743 dated Oct. 23, 2018 (7 pgs).
Japanese Office Action in Patent Application No. JP 2017-548400 dated Nov. 6, 2018 (12 pgs).
Int'l Search Report and Written Opinion dated Nov. 20, 2017 for PCT/US2017/049190 (15 pgs).
Infant Newborn Baby Anti Roll Pillow Sleep Prevent Flat Head Cushion Positioner, Walmart.com, 4 pages, downloaded Jun. 7, 2017, https:www.walmart.com/ip/infant-newborn-baby-anti-roll-pillow-sleep-prvent-flat-head-cushion-positioner/422240472?wmispartner=wipa@selected/sell%E2%80%A6.
Int'l Search Report & Written Opinion dated Nov. 4, 2014 for PCT/US14/20338.
Extended European Search Report dated Nov. 24, 2016 in EP Application No. 14779234.5.
Office Action dated Jun. 14, 2016 in Chinese Application No. 201480026205.5.
Merriam-Webster Definition: Link https://www.merriam-webster.com/dictionary/monolithic (Year: 2018).

* cited by examiner

SUPPORT ASSEMBLY FOR INFANT

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present invention is directed to an infant support device, and more particularly to a support pad for an infant.

Description of the Related Art

The body parts most susceptible to injury in an infant's body are the head, neck, spine and spinal cord, particularly in newborn babies and infants up to 6 months old. To this day there is a possibility that challenges, from learning disabilities to Autism, may be caused from injury to the spinal cord at these early stages in an infant's life. Babies rely on their care takers (e.g., parents) to hold and support their head, spine, neck and spinal cord without jarring them, all the while comforting them, such as when swaddling them, and/or rocking them in their arms, and/or when the babies are laid down (e.g., on the bed, couch). A slight jar or jolt can possibly cause short term or long term (e.g., permanent) damage to the spinal cord, causing challenges later on in life for the child, such as learning disabilities and Autism. Also, when laid down on a surface (e.g., couch, bed, table), an infant can move and roll, potentially causing injury if the infant rolls off the couch or bed while the caregiver is distracted.

New parents and others can struggle to properly hold newborn babies in a way that adequately supports the baby's head, neck, spine and spinal cord, especially when the person has not previously held newborn babies. Further, laying infants on a surface (e.g., couch, bed) can have potential risks, as discussed above, when caregivers become distracted. Proper support to the head, neck, spine and spinal cord of the newborn baby is important and lack of such proper support can result in discomfort and even injury to the baby (e.g., injury to the head or spinal cord of the baby), as discussed above.

SUMMARY

Accordingly, there is a need for an improved system for ensuring proper support for the baby's head, neck, spine and spinal cord, while the infant is laid down on a surface, and that prevents the infant from rolling off said surface and suffering injury.

In accordance with one embodiment, an infant support pad is provided. The infant support pad comprises a body of resilient material having a generally planar bottom surface and a top surface that is inclined relative to the bottom surface between a proximal end and a distal end of the body such that the infant is in an inclined position when placed on the body. The top surface has a recessed surface portion that is generally planar along a central axis of the body and an opening in a distal portion of the body configured to receive at least a portion of an infant's head therethrough when the infant is placed on the body. The infant support pad also comprises a pair of raised side members on either side of the recessed surface portion configured to generally maintain the infant on the body and inhibit movement of the infant out of the body.

In accordance with another aspect, an infant support pad is provided. The infant support pad comprises a body of resilient material having a generally planar bottom surface and a top surface that is inclined relative to the bottom surface between a proximal end and a distal end of the body such that the infant is in an inclined position when placed on the body. The top surface has an opening in a distal portion of the body and curved surface configured to receive and support at least a portion of an infant's head that extends through the opening when the infant is placed on the body. The infant support pad also comprises a pair of raised side members on either side of the top surface configured to generally maintain the infant on the body and inhibit movement of the infant out of the body.

DETAILED DESCRIPTION

Figure 1:
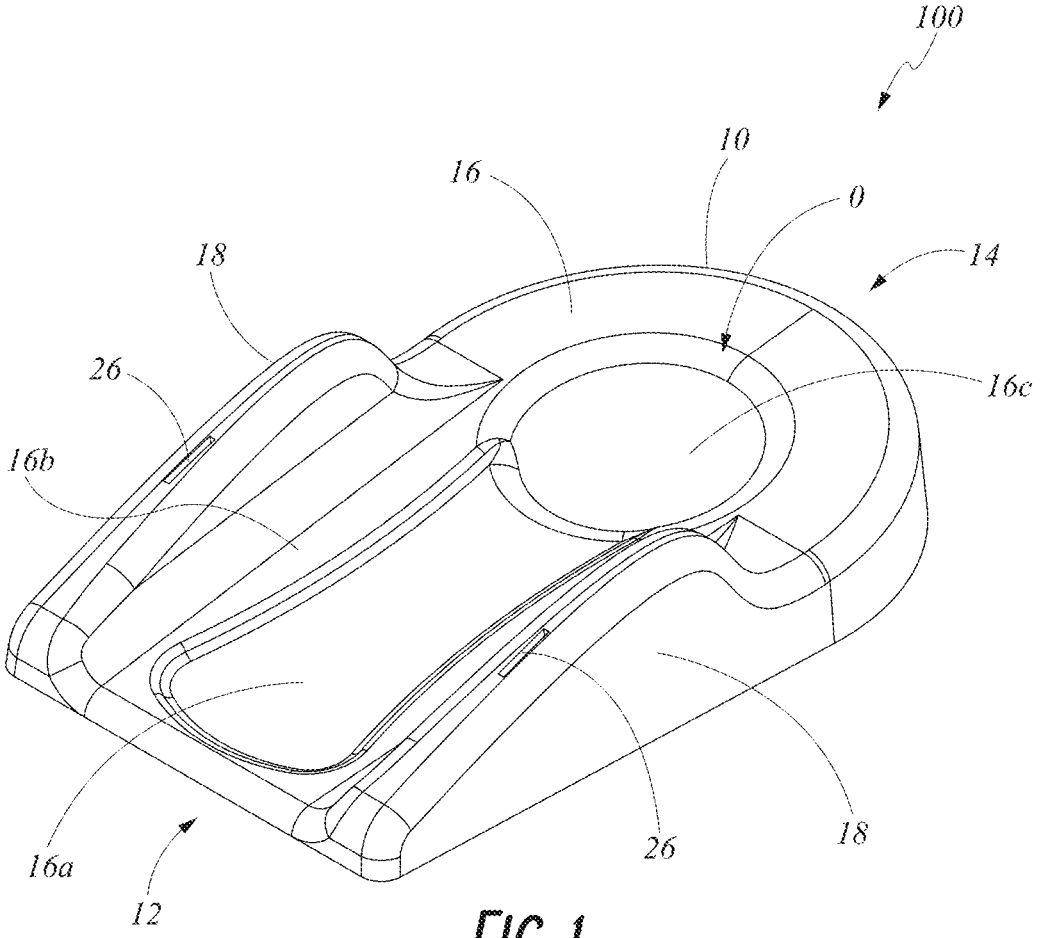
FIG. 1 is a perspective top view of one embodiment of a support pad.

FIGS. 1-8 show one embodiment of a support pad 100 that can be used to support a baby or infant. The support pad

100 can optionally be a monolithic piece (e.g., a single piece of material without seams) made of a resilient material. In one embodiment, the support pad 100 can optionally be made of polypropylene. In another embodiment, the support pad 100 can optionally be made of ethylene vinyl acetate (EVA). In other embodiments, the support pad 100 can be made of other elastomeric polymers, foam or other suitable resilient materials. In one embodiment, the support pad 100 is optionally formed using a mold (e.g., injection molded). In another embodiment, the support pad 100 can be formed using a 3D printing (or additive manufacturing) process. However, other suitable manufacturing processes can be used.

The support pad 100 can extend between a bottom end 12 and a top end 14 and can have a top surface 16 and a bottom surface 19. The top surface 16 can be contoured and include a surface 16*a* that is recessed relative to a surrounding surface 16*b*. The recessed surface 16*a* can extend along a central axis (e.g., be symmetrical about the central longitudinal axis) of the support pad 100. The top surface 16 can also define an opening O therein that is configured to receive at least a portion of an infant's head therethrough. The top surface 16 can also have a curved surface 16*c* (e.g., concave surface) that can advantageously and comfortably support at least a portion of the infant's head that extends through the opening O. The top surface 16 can be generally inclined between the bottom end 12 and top end 14 of the support pad so that when resting on the support pad 100 the infant's head is in an elevated position (i.e., not horizontal). In one embodiment, the top surface 16 is generally inclined at an angle $\alpha$ between about 5 degrees and about 15 degrees. In one embodiment, the angle $\alpha$ can be about 7 degrees. When an infant is placed on the support pad 100, such an inclined top surface 16 can advantageously aid in helping the infant fall asleep, can facilitate proper digestion, can aid in preventing acid reflux, and can facilitate breathing by the infant, all benefits described in medical literature.

Figure 2:
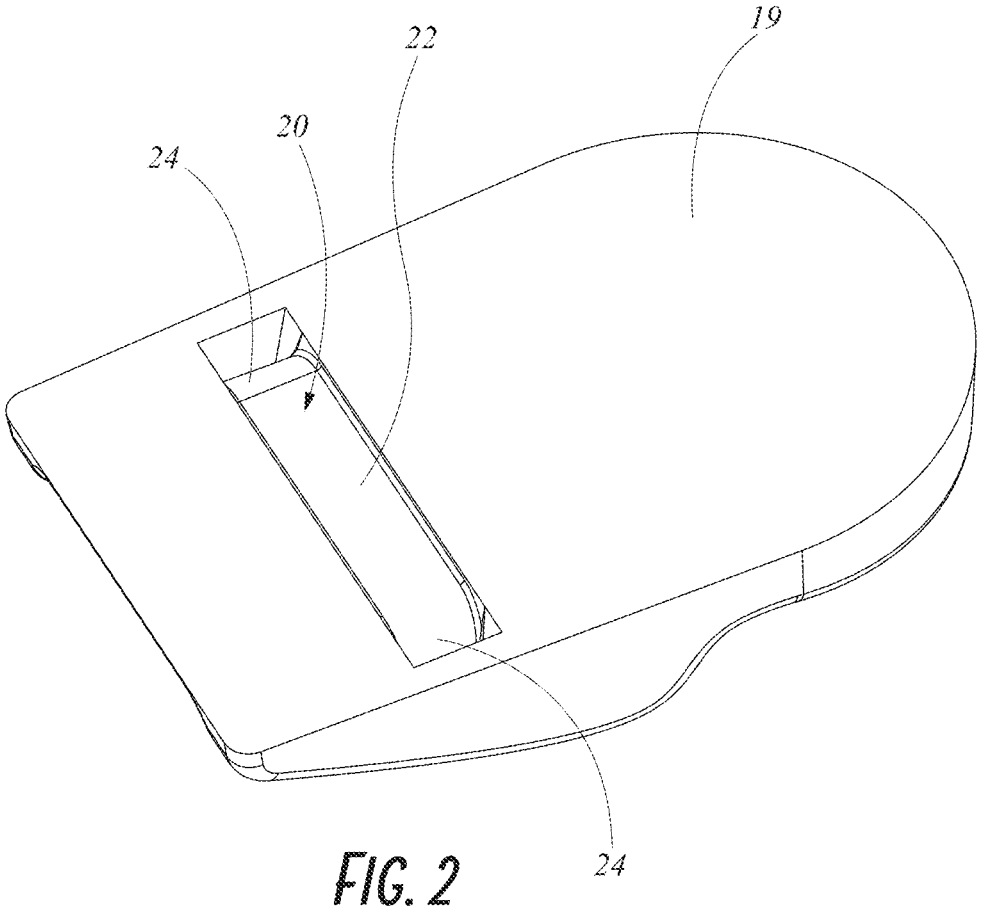
FIG. 2 is a perspective bottom view of the support pad of FIG. 1.
Figure 3:
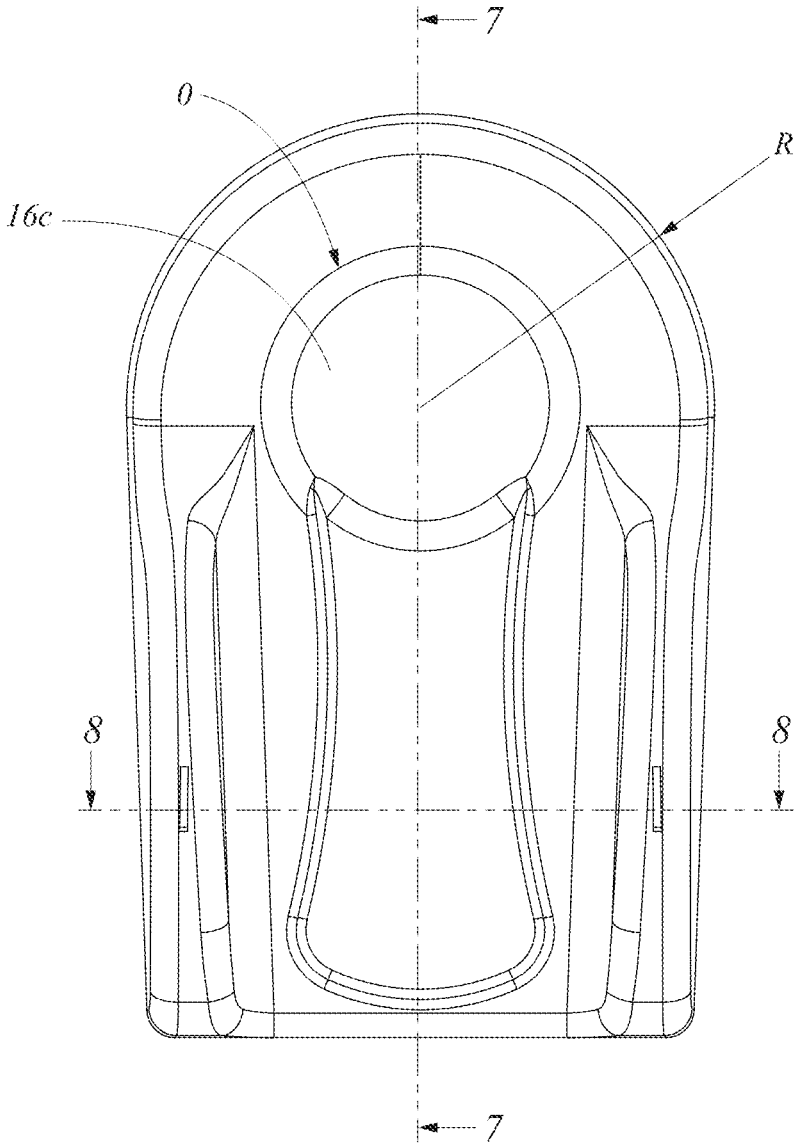
FIG. 3 is a top planar view of the support pad of FIG. 1.
Figure 4:
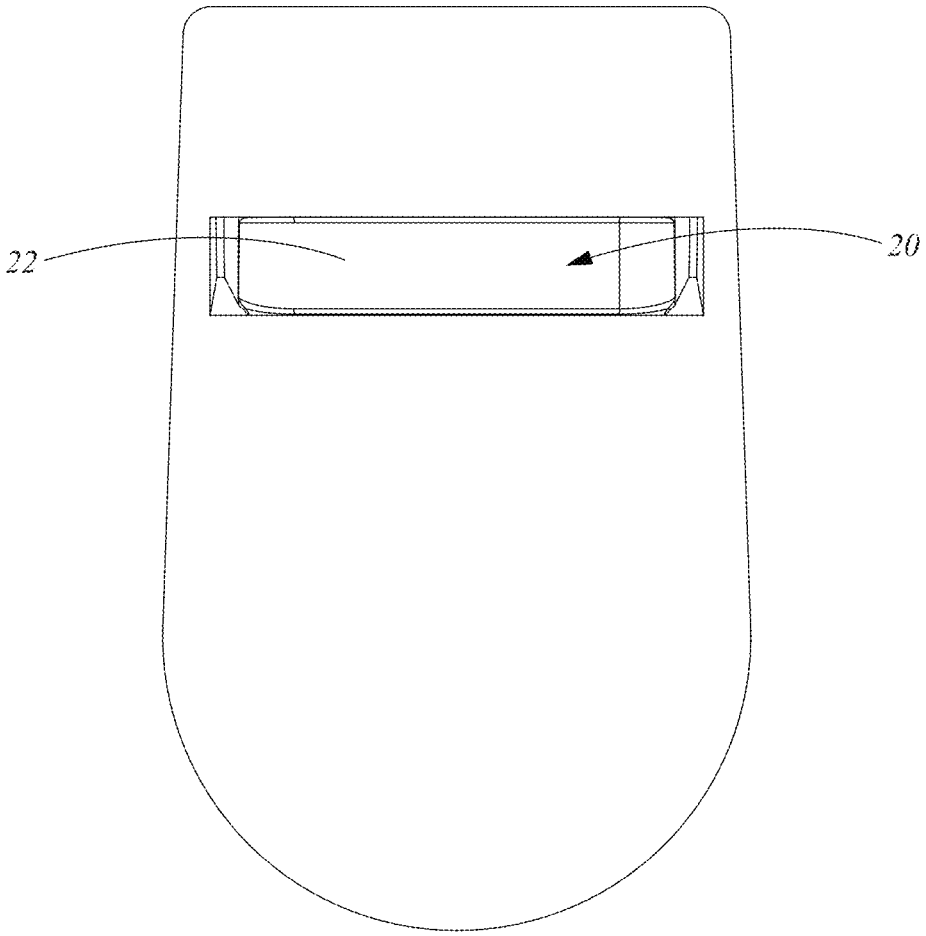
FIG. 4 is a bottom planar view of the support pad of FIG. 1.
Figure 5A:
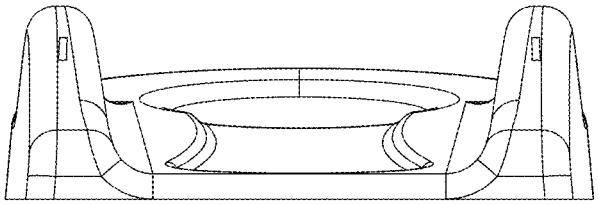
FIG. 5A is a front elevation view of the support pad of FIG. 1.
Figure 5B:
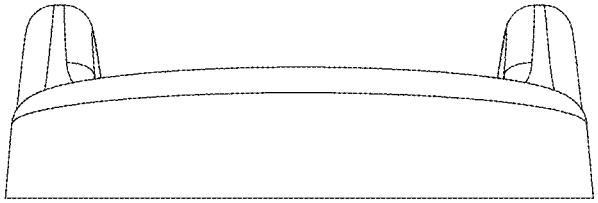
FIG. 5B is a rear elevation view of the support pad of FIG. 1
Figure 6:
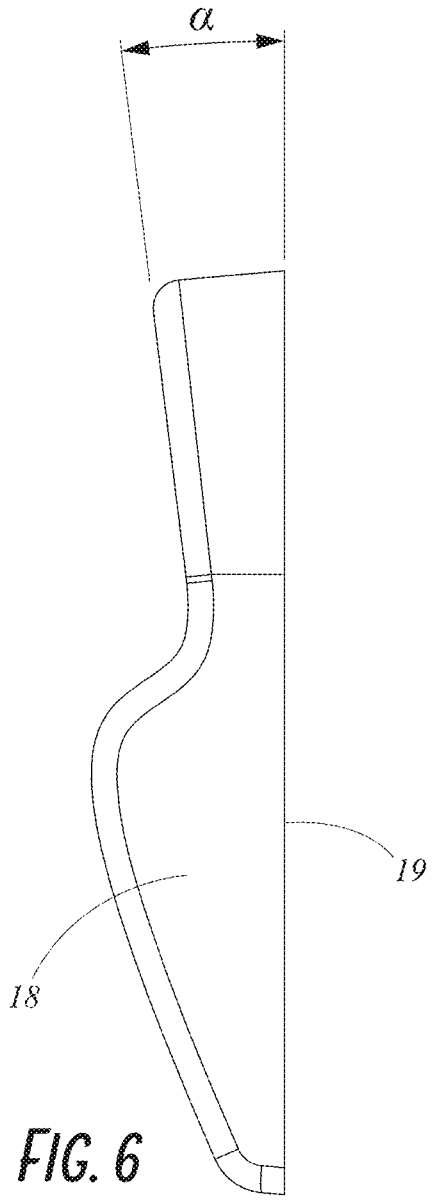
FIG. 6 is a right side view of the support pad of FIG. 1, the left side view being a mirror image.
Figure 7:
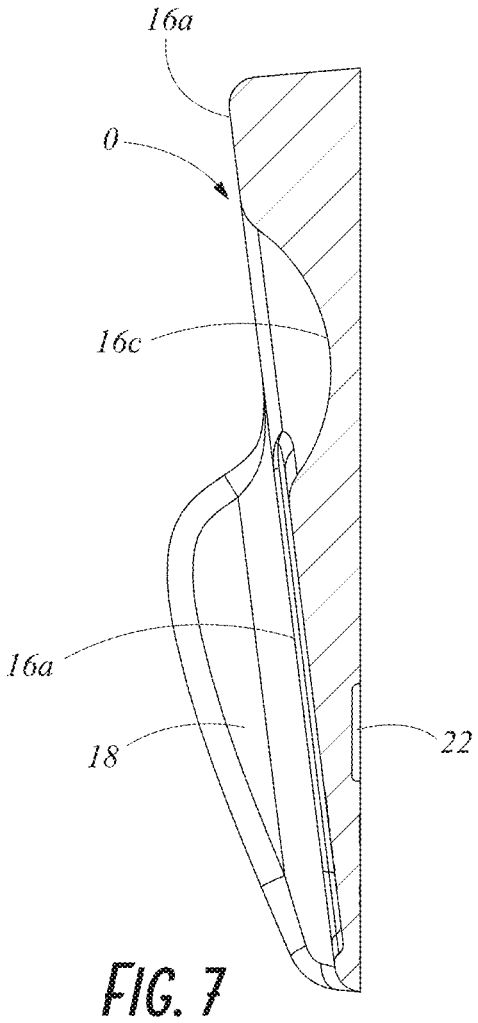
FIG. 7 is a longitudinal cross-section view of the support pad along line 7-7 in FIG. 3.
Figure 8:
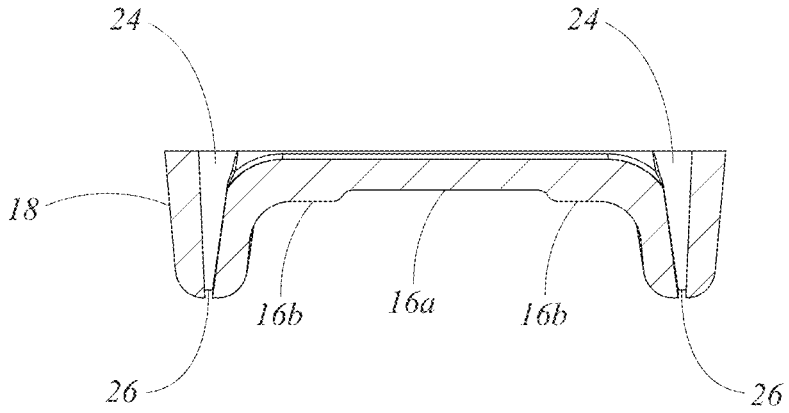
FIG. 8 is a transverse cross-section view of the support pad along line 8-8 in FIG. 3.

The support pad 100 can have a pair of raised side members 18 on either side of the recessed surface 16*a*, which have a height greater than a height of the portion of the top surface 16 that extends between the side members 18. The raised side members 18 can advantageously retain the infant in place between the side members 18 and thereby inhibit (e.g., prevent) an infant from shifting out of the support pad 100 (e.g., the side members 18 can serve as anti-roll features that can prevent the infant from rolling out of the support pad 100, thereby helping to prevent sudden infant death syndrome (SIDS)). As best shown in FIGS. 2, 4, and 8, the raised side members 18 can have openings 26 through which portions of a belt (not shown) can optionally extend and which can be fastened to each other over the infant to also aid in retaining the infant in place on the support pad 100. The belt can be considered a 2-point harness as it secures the infant in place on the support pad 100 in two places, such as on either side of the infant's body. Such a belt can extend through channels 24 (see FIG. 8) in the raised members 18 and along a recessed portion 20 of the bottom surface 19. The recessed portion 20 can define a surface 22 that is recessed relative to the bottom surface 19. The bottom surface 19 can be generally planar to provide stability to the support pad 100 when resting on a surface (e.g., a couch surface, table surface, surface of a bed).

Figure 9:
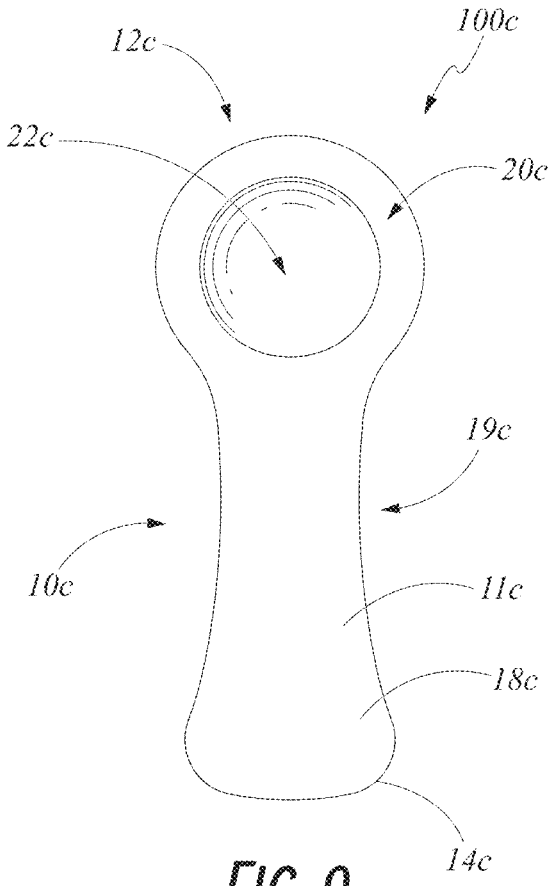
FIG. 9 is a top view of one embodiment of an infant support device for use with the support pad of FIG. 1.

FIG. 9 shows one embodiment of an infant support device 100C that can optionally be used with the support pad 100. The infant support device 100C can have a body 10C that extends from a proximal edge 12C to a distal edge 14C and between a medial edge and a lateral edge. In the illustrated embodiment, the proximal edge 12C can be curved (e.g., extend along a curve between the medial and lateral edges) and the distal edge 14C can be generally curved between the medial and lateral edges. The curved distal edge 14C can more comfortably support the baby's or infant's lower spine. The body 10C can have a top surface 11C with a generally planar distal portion 18C and a curved section 22C at a proximal portion 20C of the body.

Figure 10:
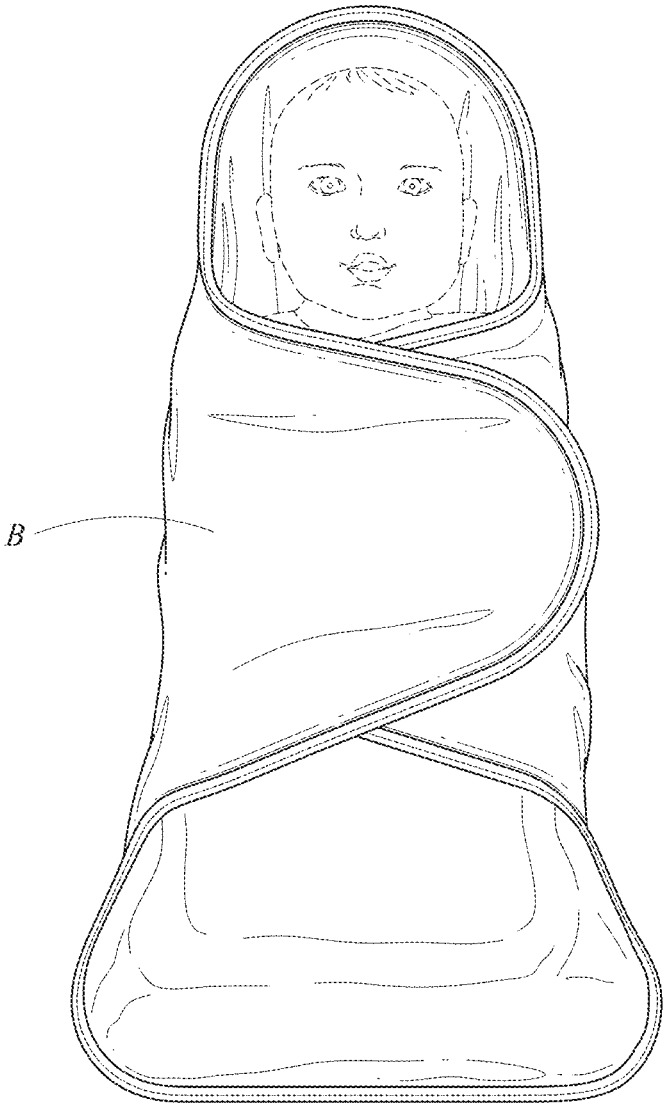
FIG. 10 is a top view of an infant in a swaddling blanket, which can include the infant support device of FIG. 9.

A width 19C of the body 10C of the support device 100C can narrow (e.g., decrease in width) between the proximal portion 20C and the distal end 14C. In the illustrated embodiment, the support device 100C is shaped similar to a keyhole in top planar view (e.g., such that the medial and lateral edges of the body 10C between the proximal and distal portions 20C, 18C are curved edges). In the illustrated embodiment, the width 19C of the body narrows to a width smaller than a width at the distal end 14C. Advantageously, the contoured width (e.g., narrower width 19C of the body 10C) allows the user to hold the newborn baby or infant closer to their body when the support device 100C is incorporated into a blanket body B (see FIG. 10), and facilitates holding the baby or infant more comfortably for the user when holding the swaddled baby or infant. Further details on embodiments of a baby support device 100C can be found in U.S. application Ser. No. 14/997,979, filed Jan. 18, 2016, which is incorporated herein by reference in its entirety and should be considered a part of this specification.

The recessed surface 16*a* of the support pad 100 is advantageously shaped to receive the support device 100C so that the distal portion 18C of the support device 100C fits the recessed surface 16*a*, and so that the curved section 22C fits through the opening O in the top surface 16 and adjacent the curved surface 16*c* in the support pad 100. In one embodiment, the support device 100C can optionally be disposed in the recessed portion 16*a* of the support pad 100 to provide additional support to the baby or infant while lying on the support pad 100. In another embodiment, the support pad 100 can be used without the support device 100C. In still another embodiment, the baby or infant can be swaddled in a blanket B (see FIG. 10) and then placed on the support pad 100. Optionally, the blanket B can have a pocket that removably receives the support device 100C. In still another embodiment, the baby or infant can be swaddled in the blanket B and placed on the support pad 100 with the support device 100C between the blanket B and the support pad 100. In still another embodiment, the blanket B can be used without the support device 100C (e.g., the swaddled infant can be placed directly on the support pad 100).

Figure 11:
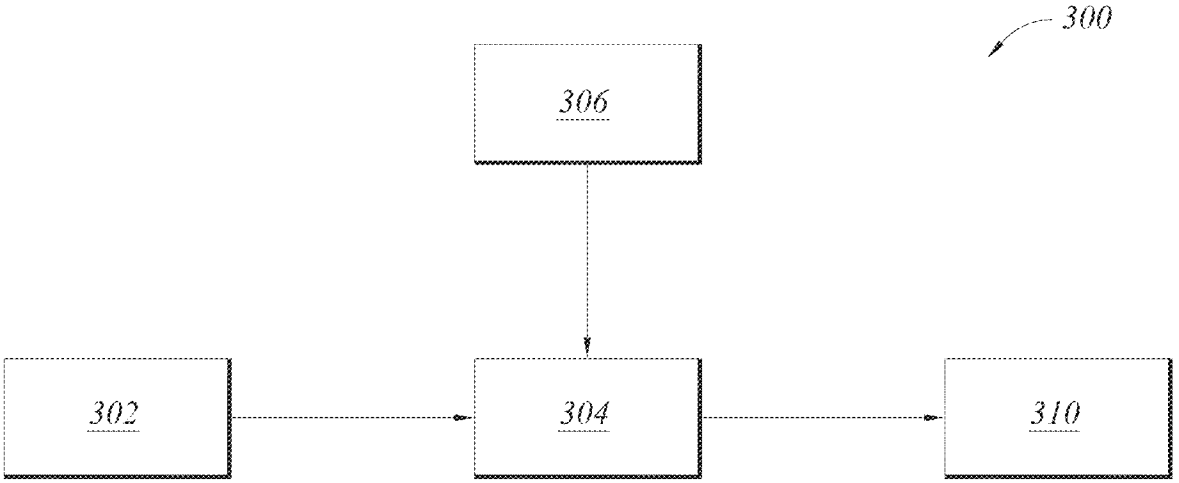
FIG. 11 is a schematic block diagram of one embodiment of a heating or cooling system for use with a support pad, as in FIG. 1.

FIG. 11 shows a schematic view of a heating or cooling system 300 having one or more heating or cooling elements 310 (e.g., resistive heating elements, thermoelectric elements such as Peltier elements micro chips, phase change material) that can be incorporated into (e.g., embedded in) the support pad 100 and/or support device 100C to heat or cool a surface of the pad (e.g. top surface 16) to provide heating or cooling to the infant to increase their comfort while lying on the support pad 100. In another embodiment, the one or more heating or cooling elements 310 can be provided on an outer surface of the support pad 100. In still another embodiment, the heating or cooling system 300 can be in a separate component that can be removably coupled to the support pad 100.

In one embodiment, the heating or cooling element 310 can include a fan that is separate from the support pad 100 and can flow air via one or more conduits (not shown) to the support pad 100. In one embodiment, said one or more conduits can be placed in fluid communication with one or more flow passages through the body of the support pad 100 to direct air (e.g., heated air, cooled air) through said flow passages. The one or more flow passages can communicate with one or more ports or openings or perforations on the top surface 16 of the support body to direct air (e.g., heated air, cooled air) to the infant while on the support pad 100. In one embodiment, heating or cooling element 310 can also include a heater or a cooler disposed downstream of the fan to heat or cool airflow from the fan before it enters the body of the support pad 100.

The heating or cooling system 300 can include a switch 302 that can be actuated by a user to turn the heating or cooling system 300 ON and OFF. In one embodiment, the switch 302 can be provided on a surface (e.g., a bottom surface) of the support pad 100. The switch 302 can communicate with a controller 304 (e.g., electronic controller) that controls operation of the one or more heating or cooling elements 310. The heating or cooling system 300 can have one or more batteries 306 (e.g., low voltage batteries), that can provide power to the controller 304 and heating or cooling elements 310. In one embodiment, the heating or cooling system 310 can include a temperature sensor (e.g. at the one or more heating or cooling elements 310 or on a surface of the support pad 100) that communicates sensed temperature information to the controller 304.

In one embodiment, the controller 304 operates the one or more heating or cooling elements 310 a predetermined temperature set point. In another embodiment, the switch 302 can be operated by the user to select one of a plurality of temperature settings (e.g., low, medium, high), and the controller 304 can control the operation of the one or more heating or cooling elements 310 (e.g., control the amount of power provided by the one or more batteries 306 to the one or more heating or cooling elements 310) based upon the user selected temperature set point provided by the switch 302. In one embodiment, the controller 304 can include (or can be) a temperature limiting switch that can shut power to the one or more heating or cooling elements 310 if a temperature limit of the switch is exceeded. The temperature limiting switch can normally be closed during operation of the heating system 300, and can open if the temperature limit for the switch is exceeded. Advantageously, the heating or cooling system 300 can be selectively operated by a user to provide additional warmth for the baby and help keep the baby warm and comfortable in cold weather, or additional cooling to the baby to help keep the baby cool and comfortable in hot weather.

Figure 12:
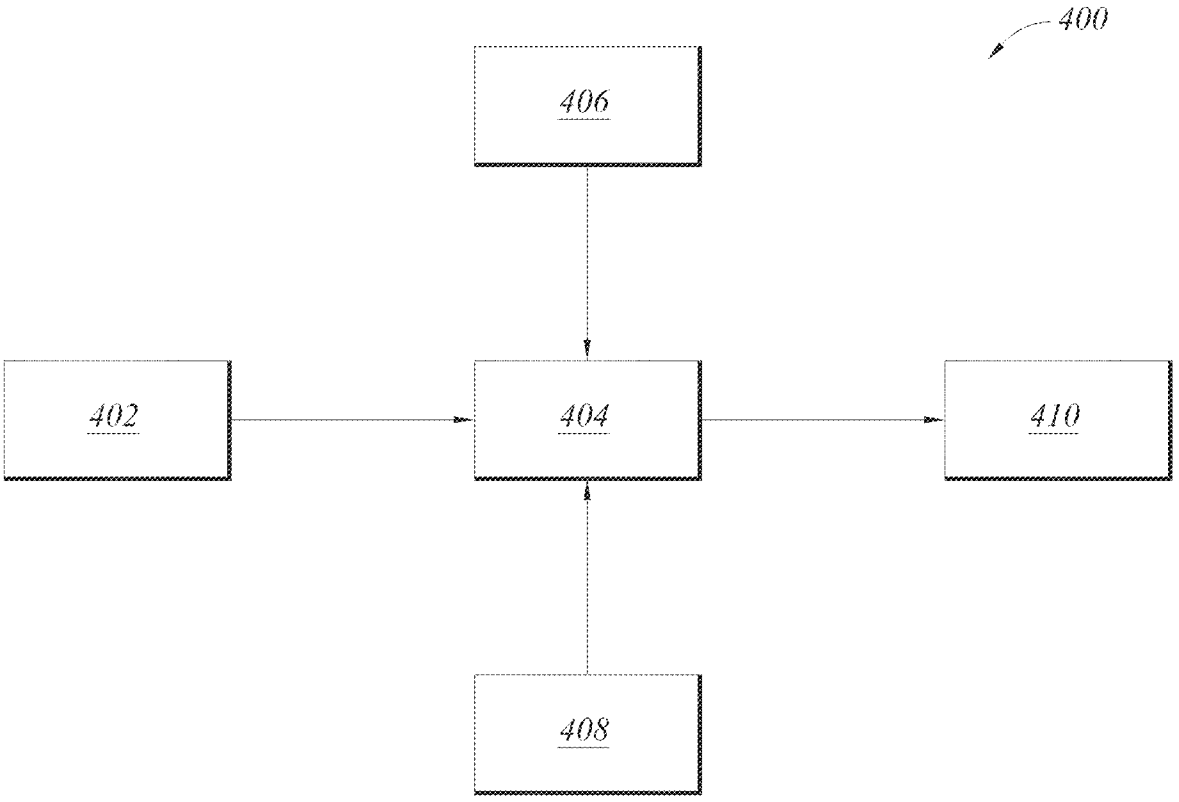
FIG. 12 is a schematic block diagram of one embodiment of a sound or vibration system for use with a support pad, as in FIG. 1.

FIG. 12 shows a schematic view of a sound or vibration system 400 having one or more vibration elements 410 (e.g., speakers, such as piezo speakers). In one embodiment, the one or more vibration elements 410 can be incorporated within the support pad 100 (e.g., embedded in the support pad 100). In another embodiment, the one or more vibration elements 410 can be provided on an outer surface of the support pad 100. In still another embodiment, the sound or vibration system 400 can be in a separate component (e.g., a sleeve) from the support pad 100 that is removably coupled to the support pad 100.

The sound or vibration system 400 can include a switch 402 that can be actuated by a user to turn the sound or vibration system 400 ON and OFF. In one embodiment, the switch 402 can be provided on a surface (e.g., a bottom surface) of the support pad 100. The switch 402 can communicate with a controller 404 (e.g., electronic controller) that controls operation of the one or more vibration elements 410. The sound or vibration system 400 can have one or more batteries 406 (e.g., low voltage batteries), that can provide power to the controller 404 and vibration elements 410. The sound or vibration system 400 can also include a memory 408 that can store one or more sounds or vibrations (e.g., heartbeat, breathing sound, custom songs), which can be downloaded via a wired connection or wireless connection (e.g., using WiFi, Bluetooth®, other RF communication) from an electronic device, such as a smartphone, tablet computer, laptop or desktop computer, such as via an app. The sound or vibration system 400 can communicate such one or more sounds with the one or more vibration elements 410 via the controller 404. In one embodiment, the sound or vibration system 400 can allow the user to record user selected sounds (e.g., Mother's heartbeat, breathing, and/or voice) to the memory 408.

In one embodiment, the controller 404 operates the one or more vibration elements 410 to provide a predetermined sound or vibration. In another embodiment, the switch 402 can be operated by the user to select one of a plurality of sound settings (e.g., heartbeat, breathing, ocean waves), and the controller 404 can control the operation of the one or more vibration elements 310 (e.g., control the amount of power provided by the one or more batteries 406 to the one or more vibration elements 410, or the sound broadcast by the vibration elements 410 via the memory 408) based upon the user selected sound setting provided by the switch 402. In one embodiment, the controller 404 can include a sound limiting switch that can shut power to the one or more vibration elements 410 if the sound level exceeds a predetermined decibel level. The sound limiting switch can normally be closed during operation of the sound or vibration system 400, and can open if the decibel limit for the switch is exceeded. Advantageously, the sound or vibration system 400 can be selectively operated by a user to provide sounds and/or vibrations to comfort and soothe the baby while being supported on the support pad 100.

In one embodiment, the support pad 100 can have the heating or cooling system 300 and the sound or vibration system 400 incorporated therein.

Figure 13:
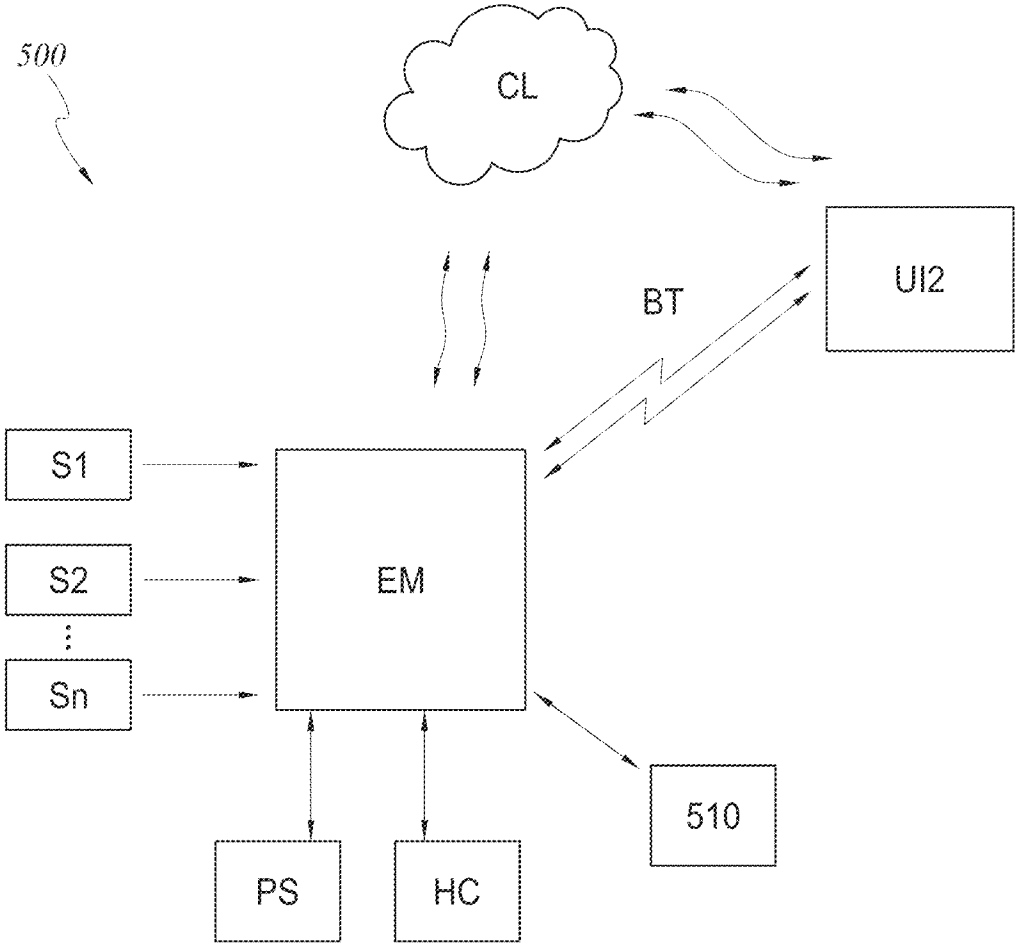
FIG. 13 is a schematic block diagram of one embodiment of a control system for a support pad, as in FIG. 1.

FIG. 13 shows a schematic of a control system 500 for the support pad 100. The control system 500 can have a controller or control circuitry EM (e.g., the controller 304, 404). The controller EM can communicate with one or more heating/cooling elements or sound/vibration elements HC and one or more sensors S1-Sn, which can optionally be on or embedded in the body of the support pad 100. The control system 500 can also have one or more power storage elements PS (e.g., batteries) that communicates with the controller EM. In one embodiment, the one or more power storage elements PS are rechargeable batteries. In another embodiment, the rechargeable batteries can be in a rechargeable battery pack that can be charged separately in a charging module. In another embodiment, the battery pack need not be removed and the support pad 100 can be placed on a recharging station. In one embodiment, the one or more power storage elements PS can be recharged via inductive coupling. In one embodiment, the recharging station can double as a night light.

In one embodiment, one or more of the sensors S1-Sn can include a weight or load sensor S1 that can sense when an infant has been placed on the support pad 100. In one embodiment, the weight sensor S1 can also measure weight of the infant when the infant is laid on the support pad 100. In one embodiment, one or more sensors S1-Sn can include a moisture sensor that can sense moisture to detect if an infant needs to be changed. In one embodiment, the controller EM can communicate the measured weight to the user or a remote electronic device (e.g., via a smartphone or tablet computer, laptop computer, etc.), such as to a database that can store the measured weight readings.

Optionally, the controller EM can operate one or more night lights 510 (e.g., LEDs) attached to or embedded in the support pad 100 when the load sensor S1 indicates that an infant has been placed on the support pad 100. In one embodiment, the night light 510 can be operated (by the controller EM) continuously while the load sensor S1 senses that an infant is on the support pad 100. In another embodiment, the light 510 can be operated (by the controller EM) for a predetermined period of time or for a time previously set by the user (e.g., preset on a timer). In another embodiment, the controller EM can communicate one or more signals (e.g., visual alarm, audio alarm) to the user (e.g., via a smartphone or tablet computer, laptop computer, etc.) if the load sensor S1 senses that the infant is trying to exit the support pad 100.

In one embodiment, the one or more sensors S1-Sn can include a sound sensor S2, which can sense if the baby is crying (e.g., if decibels are above a predetermined level). In one embodiment, the controller EM (e.g., controller 404) can operate one or more sound or vibration elements 410 to try to comfort the infant. In another embodiment, the controller EM can communicate one or more signals (e.g., visual alarm, sound alarm) to an interface UI2 on a remote electronic device (e.g., smart phone, tablet computer) via a short range wireless interconnection BT (e.g., Bluetooth) or via the cloud CL (e.g., via a WiFi or cellular connection). In one embodiment, the user's electronic device (e.g., smart phone, tablet computer) may have a software app stored or loaded thereon that allows communication between the electronics on the support pad 100 and the remote electronic device.

In still another embodiment, the one or more sensors S1-Sn can include a motion sensor S3, which can sense motion by the baby while on the support pad 100. In one embodiment, the controller EM can communicate one or more signals (e.g., visual alarm, sound alarm) to the interface UI2 on the remote electronic device if the level of sensed movement is above a predetermined level (e.g., a level that may indicate that the infant may be awake or that the infant is trying to exit the support pad 100).

In still another embodiment, the one or more sensors S1-Sn can include a temperature sensor S4, which can sense a temperature of the baby while on the support pad 100. In one embodiment, the temperature sensor S4 is incorporated into the body of the support pad 100. In another embodiment, the temperature sensor S4 can be incorporated into the infant support device 100C. In one embodiment, the controller EM can communicate one or more signals (e.g., visual alarm, sound alarm) to the interface UI2 on the remote electronic device if the temperature sensed by the sensor S4 is above a predetermined amount (e.g., a temperature amount that may indicate that the infant's temperature may be too high, like a fever, or may be too low).

In still another embodiment, the one or more sensors S1-Sn can include a heartrate sensor or monitor S5, which can sense a heart rate of the baby while on the support pad 100. In one embodiment, the heartrate monitor or sensor S5 can be incorporated into the body of the support pad 100. In another embodiment, the temperature sensor S4 can be incorporated into the infant support device 100C. In one embodiment, the controller EM can communicate one or more signals (e.g., visual alarm, sound alarm) to the interface UI2 on the remote electronic device and/or an interface on the support pad 100 if the sensed heartbeat is abnormal.

In one embodiment, the support pad 100 can be used as a sleeping pad to support the infant while sleeping or napping. In another embodiment, the support pad 100 can be used as a changing pad to support the infant while having their diaper or clothing changed. In still another embodiment, the support pad 100 can be used as a support pad for the infant while bathing. In some embodiments, the support pad 100 can have a width of between about 6 inches and about 20 inches, in one embodiment about 17 inches. In some embodiments, the support pad 100 can have a length of between about 10 inches and about 45 inches, in one embodiment about 32 inches. In some embodiments, the support pad 100 can have a thickness of between about 4 inches and about 6 inches, in one embodiment about 4 inches. In some embodiments, the support pad 100 can display an animated image.

FIGS. 14-18 show embodiments of a support pad 100 and outer padded bed 600 combination that can be used to support a baby or infant.

Figure 14:
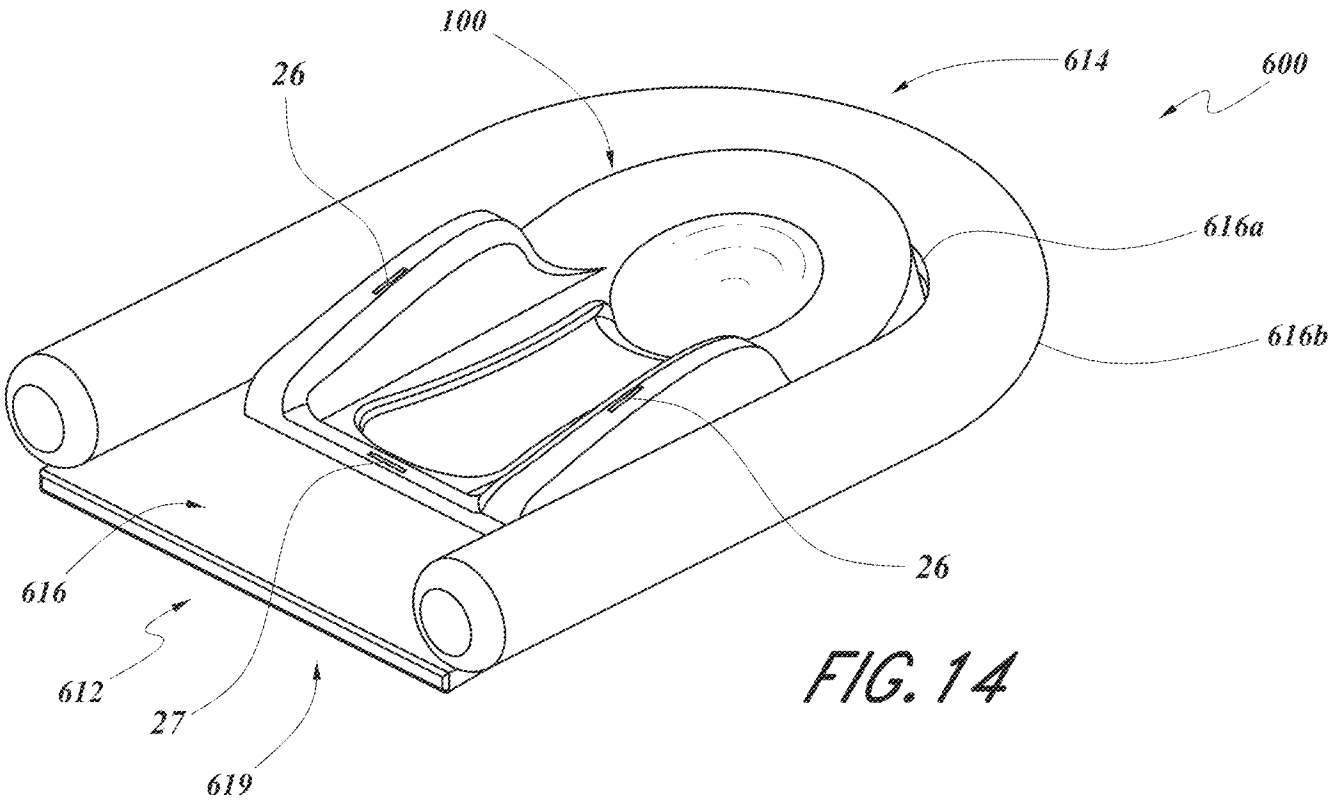
FIG. 14 is a perspective top view of one embodiment of a support pad and outer padded bed.

In some embodiments, the support pad 100 and outer padded bed 600 can be separate pieces. The outer padded bed 600 can extend from a top end 614 to a bottom end 612. The outer padded bed 600 can have a top surface 616 and bottom surface 619. The outer padded bed 600 can have an outer padding 616*b* positioned around at least the perimeter of the top end 614 and the sides of the outer padded bed 600. The outer padding 616*b* can optionally also be positioned around the perimeter of the bottom end 616 of the outer padded bed 600. The outer padding 616*b* can be positioned around the perimeter of the outer padded bed 600 to define an inner surface 616*a* to receive the support pad 100. As shown in FIG. 14, the support pad 100 can be circumscribed by the inner surface 616*a*. The inner surface 616*a* of the outer padded bed 600 may have a similar shape or profile of the support pad 100. The inner surface 616*a* of the outer padded bed 600 may also receive a support pad 100 of various sizes and types. The support pad 100 can be secured to the outer padded bed 600 in various ways, such as with corresponding hook and loop type fasteners (e.g., VELCRO®). In one embodiment, the support pad 100 can include wells or recesses on the bottom surface 619 which receive or mate with corresponding shaped protrusions of the top surface 616 of the outer padded bed 600. In another variation, the top surface 616 can have wells or recesses that receive or mate with corresponding shaped protrusions on the bottom surface of the support pad 100. The protrusions can be shaped and positioned to prevent the support pad 100 from shifting or sliding in a lateral and/or longitudinal direction. Additionally, the size of the inner surface 616*a* can be appropriately sized and shaped such that the outer padding 616*b* can secure the support pad 100.

As the infant matures and grows to a toddler or child, the toddler or child may outgrow the support pad 100 in size and may no longer need to be restrained. The support pad 100 can be removed and the outer padded bed 600 can be used as a miniature bed. The outer padding 616*b* can provide a protective perimeter around the toddler or child, who is positioned in the inner surface 616*a*. The outer padding 616*b* can inhibit (e.g., prevent) the toddler or child from rolling off the bed. The outer padding 616*b* can also inhibit (e.g., prevent) others (e.g. parents) from rolling or laying on the toddler or child (e.g., where the outer padded bed 600 is placed on the bed the parents sleep on) by creating a protective barrier around the toddler or child.

The inner surface 616*a* of the outer padded bed 600 may be reversible such that either surface may be used as the top surface. In some embodiments, the top inner surface 616*a* may include features to secure the support pad 100 as described above (e.g. VELCRO® and/or protrusions). In some embodiments, the bottom inner surface 619*a* may padded or cushioned for the toddler or child, for use without the support pad 100.

Figure 15:
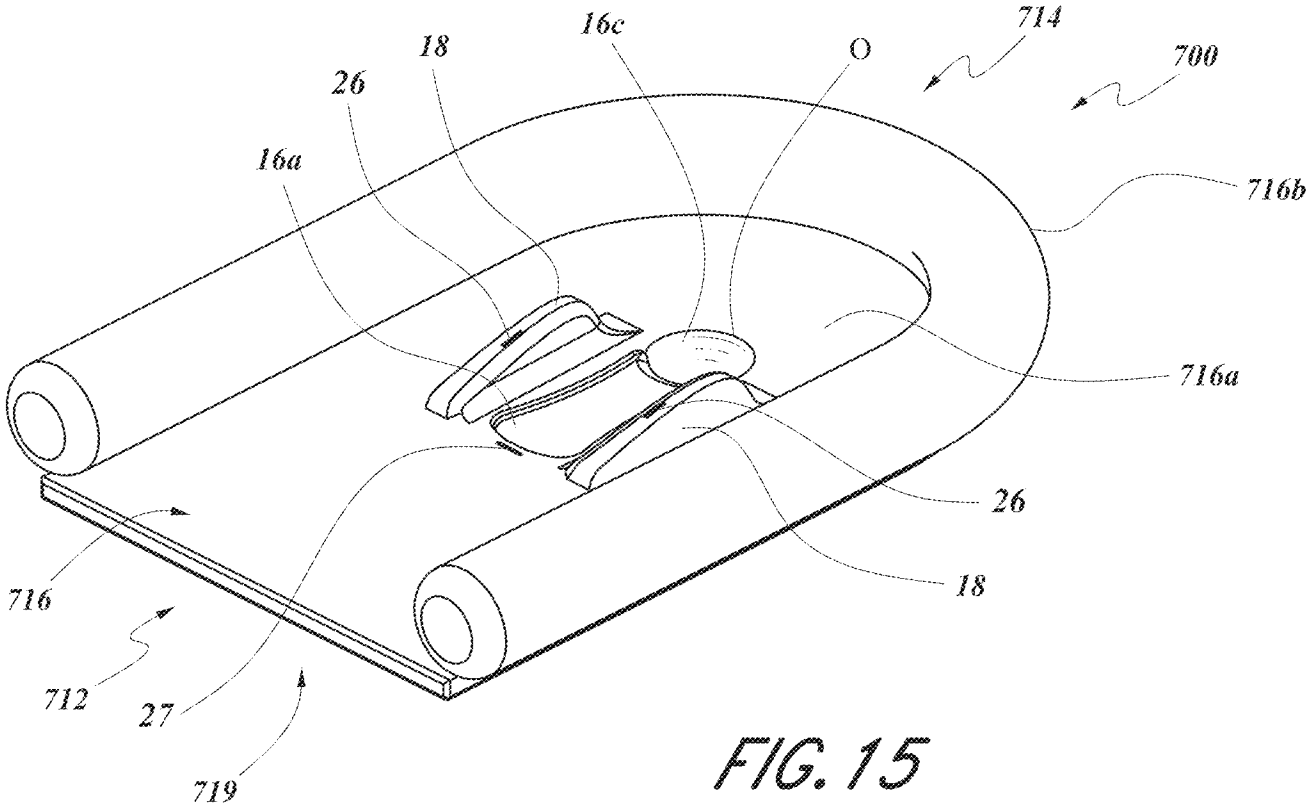
FIG. 15 is a perspective top view of one embodiment of the support pad and outer padded bed integrated in a combined bed.
Figure 16:
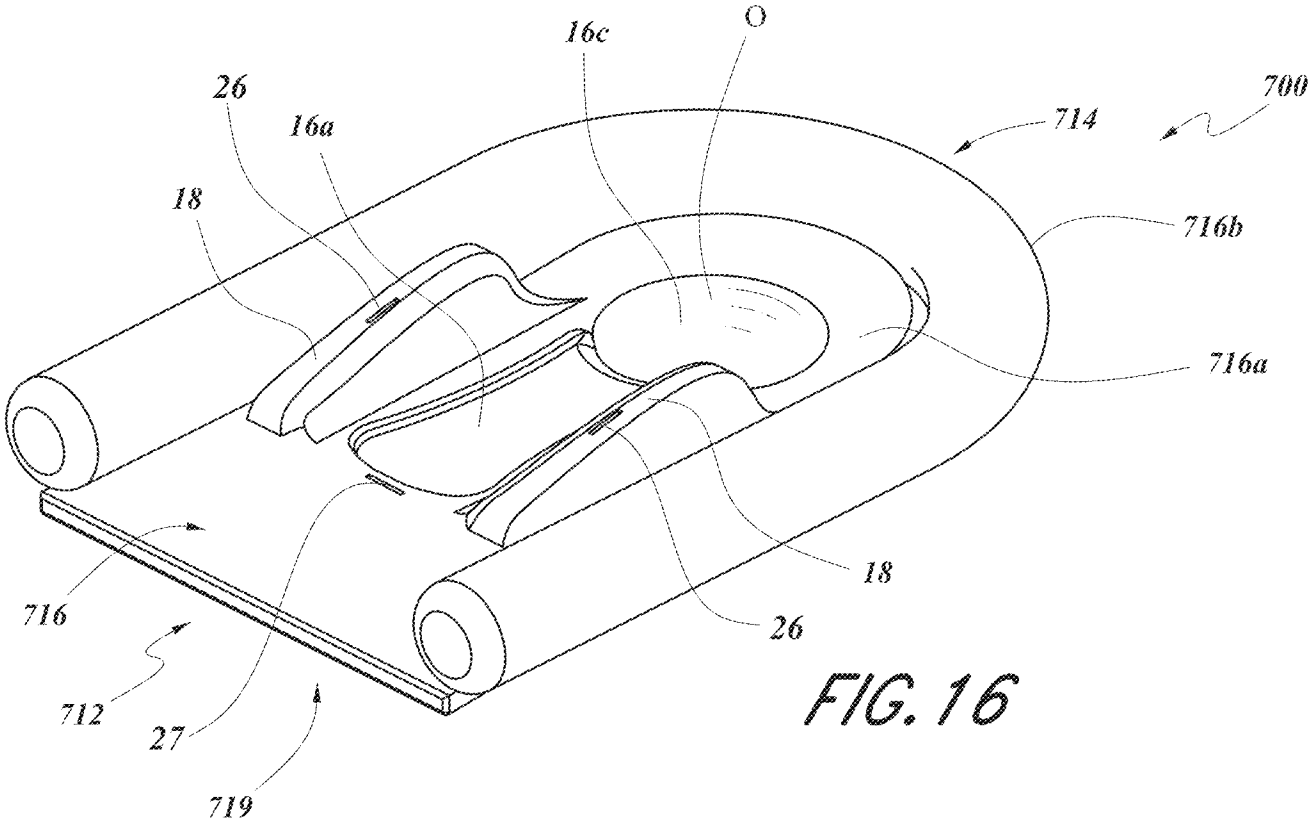
FIG. 16 is a perspective top view of another embodiment of the support pad and outer padded bed integrated in a combined bed.
Figure 17:
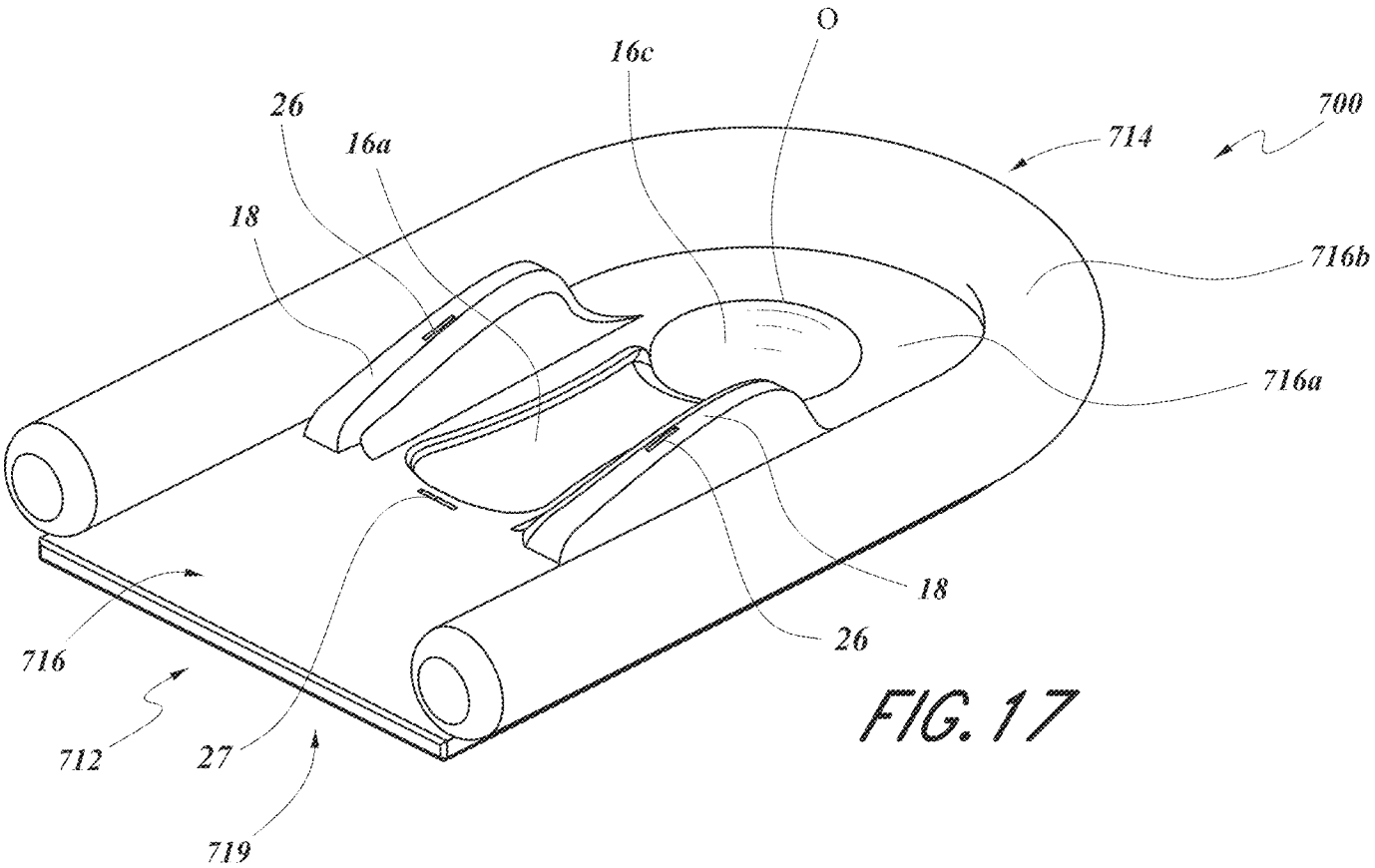
FIG. 17 is a perspective top view of yet another embodiment of the support pad and outer padded bed integrated in a combined bed.

As shown in FIGS. 15-17, the support pad 100 and outer padded bed 600 can be integrated in a combined bed 700, such that the components are a singular piece. The features of the support pad 100 is built into the inner surface 716*a* formed by the outer padding 716*b*. The top surface 716 can be contoured and include a surface 16*a* that is recessed relative to a surrounding surface 16*b*. The recessed surface 16*a* can extend along a central axis (e.g., be symmetrical about the central longitudinal axis) of the combined bed 700. The top surface 716 of the bed 700 can also have a curved surface 16*c* (e.g., concave surface) that can advantageously and comfortably support at least a portion of the infant's head that extends through the opening O. Similar to the previous embodiments, the top surface 716 can optionally be generally inclined between the bottom end 712 and top end 714 so that when resting within the top surface 716 of the recess 16*c* the infant's head is in an elevated position (i.e., not horizontal). The system 700 can have a pair of raised side members 18 on either side of the recessed surface 16*a*, which have a height greater than a height of the portion of the top surface 716 that extends between the side members 18. The raised side members 18 can advantageously retain the infant in place between the side members 18 and thereby inhibit (e.g., prevent) an infant from shifting out of the combined bed 700 (e.g., the side members 18 can serve as anti-roll features that can prevent the infant from rolling out of the combined bed 700, thereby helping to prevent sudden infant death syndrome (SIDS)).

The dimensions and position of the various features of the combined bed 700 can vary for different user sizes, as shown in FIGS. 15-17. For example, the length of the combined bed 700 may be longer for a taller or longer user (e.g. the infant, toddler, or child) as shown in FIG. 17.

Similar to the system shown FIGS. 1-8, as best shown in FIGS. 2, 4, and 8, the system shown in FIGS. 14-18, the raised side members 18 can have openings through which portions of a belt (not shown) can optionally extend and which can be fastened to each other over the infant to also aid in retaining the infant in place on the inner surface 716*a*. Such a belt can extend through channels (not shown) in the raised members 18 and along a recessed portion (not shown) of the bottom surface 719. In some examples, the belt (not shown) can be a 2-point harness to extend through the channels (not shown) through the slots 26 of the raised members 18. The 2-point harness can accommodate different sizes of infants, such as various lengths. In some examples, the belt (not shown) can be a 3-point harness to extend through the channels (not shown) through the slots 26 of the raised members 18 and the slot 27 of the bottom portion of the support pad 100. The 3-point harness can further secure the infant and prevent the infant from sliding down the incline of the support pad. The recessed portion can define a surface that is recessed relative to the bottom surface 719.

Figure 18:
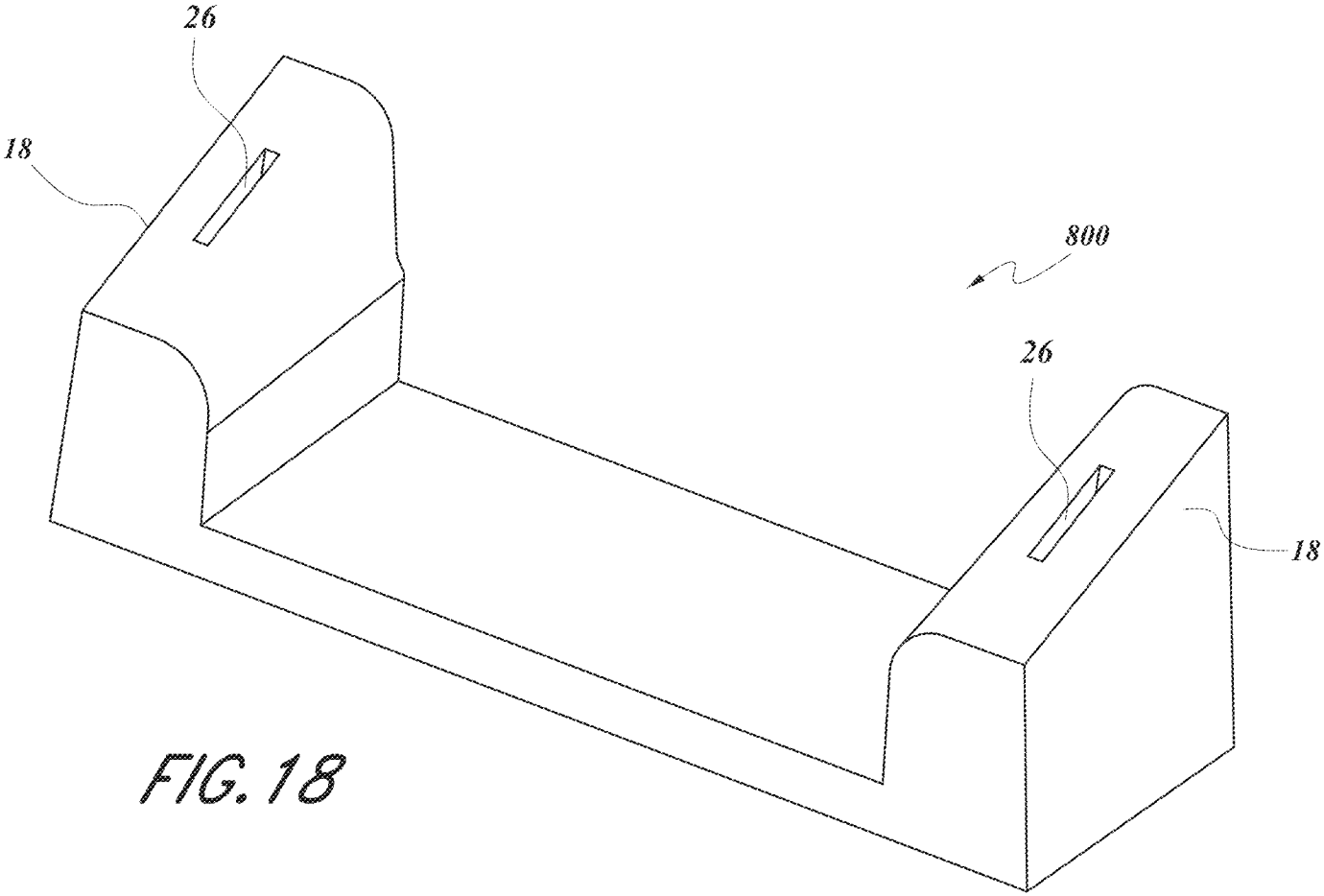
FIG. 18 is a perspective top view of an inner insert or element that can be inserted into the combined bed.

In some embodiments, an inner insert or element 800 can be inserted into the combined bed 700 as shown in FIG. 18. The inner element 800 can be inserted and positioned within the combined bed 700 to form the raised member 18. The combined bed 700 can be inflatable or made of a flexible material to receive the inner element 800, which can provide the shape and structure of the raised side members 718. Various shaped and sized inner elements 800 can be used specific to the size and shape of the user. In some embodiments, the inner element 800 can be removed from the combined bed 700 to provide a flat surface for the user.

The bottom surface 719 can be generally planar to provide stability to the combined bed 700 when resting on a surface (e.g., a couch surface, table surface, surface of a bed).

In some embodiments, the inner surface 716*a* of the combined bed 700 can be reversible, such that the features of the top surface 716 (e.g. the recessed surface 16*a*, the surrounding surface 16*b*, and the curved surface 16*c*) can be positioned on the top surface 716 or the bottom surface 719 of the combined bed 700.

Similar to the support pad 100, the outer padded bed 600 and the combined bed 700 can optionally be a monolithic piece (e.g., a single piece of material without seams) made of a resilient material. In some embodiments, the outer padded bed 600 and the combined bed 700 can optionally be made of polypropylene. In another embodiment, the outer padded bed 600 and the combined bed 700 can optionally be made of ethylene vinyl acetate (EVA). In other embodiments, the outer padded bed 600 and the combined bed 700 can be made of other elastomeric polymers, foam or other suitable resilient materials. In one embodiment, the outer padded bed 600 and the combined bed 700 is optionally formed using a mold (e.g., injection molded). In another embodiment, the outer padded bed 600 and the combined bed 700 can be formed using a 3D printing (or additive manufacturing) process. However, other suitable manufacturing processes can be used.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. An infant support pad assembly, comprising:

a body of resilient material having a generally planar bottom surface and a top surface, the top surface having a recessed surface portion that extends between a front end and a rear end and that is generally planar along a central axis of the body and a concave surface extending from an opening in the top surface and configured to receive at least a portion of an infant's head therethrough when the infant is placed on the body;

a pair of raised side members on either side of the recessed surface portion that extend above the top surface to a height above the top surface, the pair of raised side members configured to generally maintain the infant on the body and inhibit movement of the infant out of the body, the concave surface extending toward a rear end of the body past the pair of raised side members;

a first harness opening in one of the pair of raised side members and a second harness opening in another of the pair of raised side members;

a third harness opening in the top surface of the body adjacent the front end of the recessed surface portion, wherein the first harness opening and the second harness opening are in communication with channels in the pair of raised side members and a surface recessed relative to the bottom surface of the body, wherein the first harness opening, the second harness opening, and the third harness opening are configured to receive a harness therethrough to secure the infant on the support pad assembly; and an outer padding around a top side and lateral sides of the body to surround the infant when placed on the body.

2. The infant support pad assembly of claim 1, wherein the surface is inclined relative to the bottom surface between a proximal end and a distal end of the body such that the infant is in an inclined position when placed on the body.

3. The infant support pad assembly of claim 1, wherein the surface and the bottom surface are reversible.

4. The infant support pad assembly of claim 1, wherein the pair of raised side members is formed by a separate one or more pieces received between the top surface and the bottom surface of the infant support pad assembly.

5. The infant support pad assembly of claim 1 wherein the support pad assembly is monolithic.

6. The infant support pad assembly of claim 1 further comprising a support device configured to support a head, neck and spine of the infant, the top surface and opening in the body configured to receive the support device thereon.

* * * * *